US007717744B2

(12) United States Patent
Ma

(10) Patent No.: US 7,717,744 B2
(45) Date of Patent: May 18, 2010

(54) SHIELDED CONNECTOR FOR REDUCING THE DEFLECTION OF THE TERMINAL

(75) Inventor: Wen-Qiang Ma, ShenZhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 202 days.

(21) Appl. No.: 12/075,142

(22) Filed: Mar. 10, 2008

(65) Prior Publication Data

US 2008/0220663 A1 Sep. 11, 2008

(30) Foreign Application Priority Data

Mar. 9, 2007 (CN) ..... 2007 2 0035287

(51) Int. Cl.
*H01R 13/648* (2006.01)

(52) U.S. Cl. ..... 439/607.1; 439/71

(58) Field of Classification Search ..... 439/607.1, 439/71, 72, 607.01, 330, 70
See application file for complete search history.

(56) References Cited

U.S. PATENT DOCUMENTS 7,147,481 B2 * 12/2006 Yang ..... 439/71
7,156,679 B1 * 1/2007 Wang et al. ..... 439/330
7,160,116 B2 * 1/2007 Li ..... 439/73
7,232,316 B2 * 6/2007 Chen ..... 439/71
7,288,003 B2 * 10/2007 Ono et al. ..... 439/607.01

* cited by examiner

*Primary Examiner*—Hien Vu
(74) *Attorney, Agent, or Firm*—Ming Chieh Chang; Wei Te Chung; Andrew C. Cheng

(57) ABSTRACT

A shielded connector (1) comprises at least a metal housing (10) configured by first, second, third and fourth sidewalls (100, 101, 102, 103) defining a receiving space (104) therebetween, and first and second terminal insert securely attached to the first and third wall of the metal housing. Each terminal insert includes a plurality of terminals (30) molded with an insulating material, each terminal including at least a retaining section (300) which is covered by the insulating material, and defining a plane extending therethrough, and a contact section (304) with a base portion (308) extending from the retaining section, wherein the base portion is away from the plane defined by the retaining section. And each terminal further includes enlarged portion (306), which connected the retaining section and the contact section, and being out of the insulating material so as to effectively reduce the deflection during mating with an inserted element.

8 Claims, 6 Drawing Sheets

SHIELDED CONNECTOR FOR REDUCING THE DEFLECTION OF THE TERMINAL

BACKGROUND OF THE INVENTION

1. Field of the Invention

The present invention relates to a shielded connector, and more particularly to an electronic module connector for interconnecting an electronic module such as a camera module for use with a cellular phone or the like to an electrical member such as a printed circuit board. The connector includes a terminal featured with an enlarged retaining portion thereby effectively reducing deflection during mating with an inserted element.

2. Description of the Related Art

Conventionally, electronic modules such as a camera module for use with a cellular phone are securely maintained in electrical connection with an electronic member such as a printed circuit board. Therefore, an electrical connector for the camera module, formed in a shape that allows for secure insertion of the camera module, is pre-installed on the printed circuit board. Then, the camera module is inserted into the electrical connector to electrically engage therewith. Consequently, the camera module is electrically connected with the printed circuit board via the shielded connector.

For example, known as an example of the aforementioned conventional technique is a camera module connector which is described in U.S. Patent Application Publication No. 2006-0216996. This connector comprises a metal shell defining a receiving space and mounted onto the printed circuit board, a pair of insulating housings attached to the two opposite sidewalls of the metal shell, a plurality of terminals attached to the insulating housings, and a pair of shielding shells covering on the insulating housings, respectively. Each terminal comprises a retaining section, a soldering section, and a contact section. The retaining section is partly insert-molded with the insulating housing and extends uprightly. The soldering section extends upwardly and outwardly from an end of the retaining section so as to connect to the printed circuit board. The contact section extends downwardly and slantly from the other end of the retaining section toward to the receiving space. When the camera module is inserted into the receiving space from above, the pads formed on the bottom face thereof are bought into the contact section of the terminals, and the terminals are pushed toward the sidewall of the metal shell because of the pressure of the camera module. Therefore, the camera module is electrically connected with the printed circuit board via the terminals of the electrical connector.

However, all of the terminals and metal shell are made of metal, when the terminals are pushed toward the sidewall of the metal shell in the action of the pressure of the camera module, it is possible that the retaining section, which is out of the insulating housing, connected to the sidewall of the metal shell, if the deflection is excess. Consequently, a short circuit is formed in said circuit.

Thus, there is a need to provide an improved shielded connector that overcomes the above-mentioned problems.

BRIEF SUMMARY OF THE INVENTION

It is an object of the present invention to provide an electrical connector with a better electrical connection.

In order to achieve the objective above, a shielded connector in accordance with a preferred embodiment of the present invention comprises a metal housing defining a receiving space upwardly and at least having a first wall, a terminal insert securely attached to the first wall. The terminal insert includes a plurality of terminals molded with an insulating material, each terminal having a retaining section, which is covered by the insulating material, an enlarged portion, which extends from one end of the retaining section and is out of the insulating material, a contact section with a base portion extending from the end of the enlarged portion toward to the receiving space. And the retaining section defines a plane extending therethrough, from which the base portion is away. As a result, the strength of the retaining section is increased. When the camera module presses the contact section of the terminals, it is not easy that the retaining sections of the terminals, which is out of the insulating material, contacted to the metal housing. Therefore, a better electrical connection is provided between the camera module and printed circuit board.

Other objects, advantages and novel features of the invention will become more apparent from the following detailed description of the present embodiment when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like members in the figures and in which:

DESCRIPTION OF PREFERRED EMBODIMENT OF THE INVENTION

In the following detailed description, for purposes of explanation, numerous specific details are set forth in order to provide a thorough understanding of the present invention.

A shielded connector according to the present invention is applicable to an electronic apparatus such as digital cameras, PDAs (Personal Digital Assistants), PCs (Personal Computers), mobile phones or the like. In the preferred embodiment illustrated in FIGS. 1-6, the shielded connector 1 is used in a mobile handset (not shown) for connecting a camera module 3 to a PCB 2.

Figure 1:
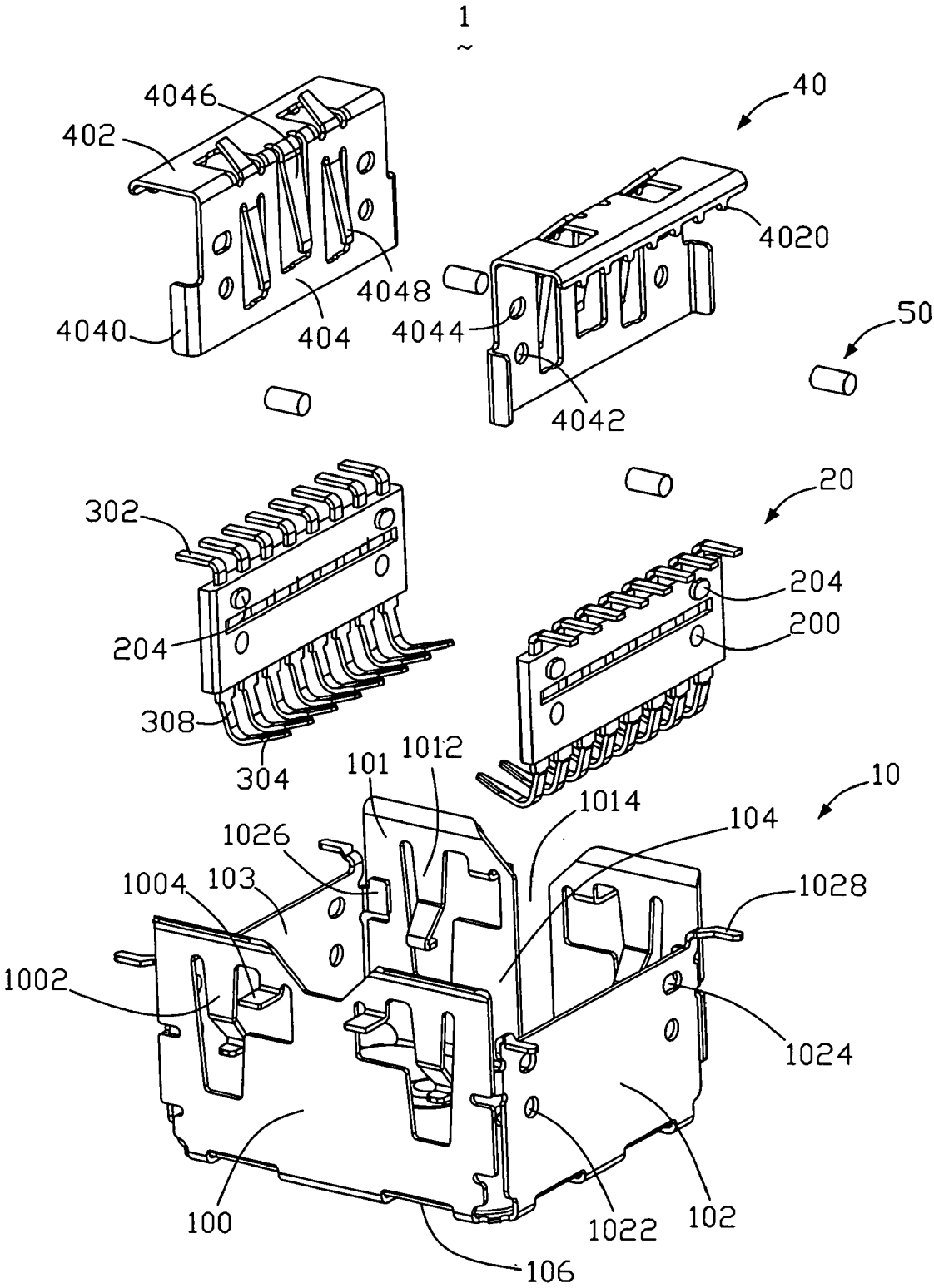
FIG. 1 is an exploded view of a shielded connector of the present invention, wherein the terminals are attached to the insulating housing.
Figure 2:
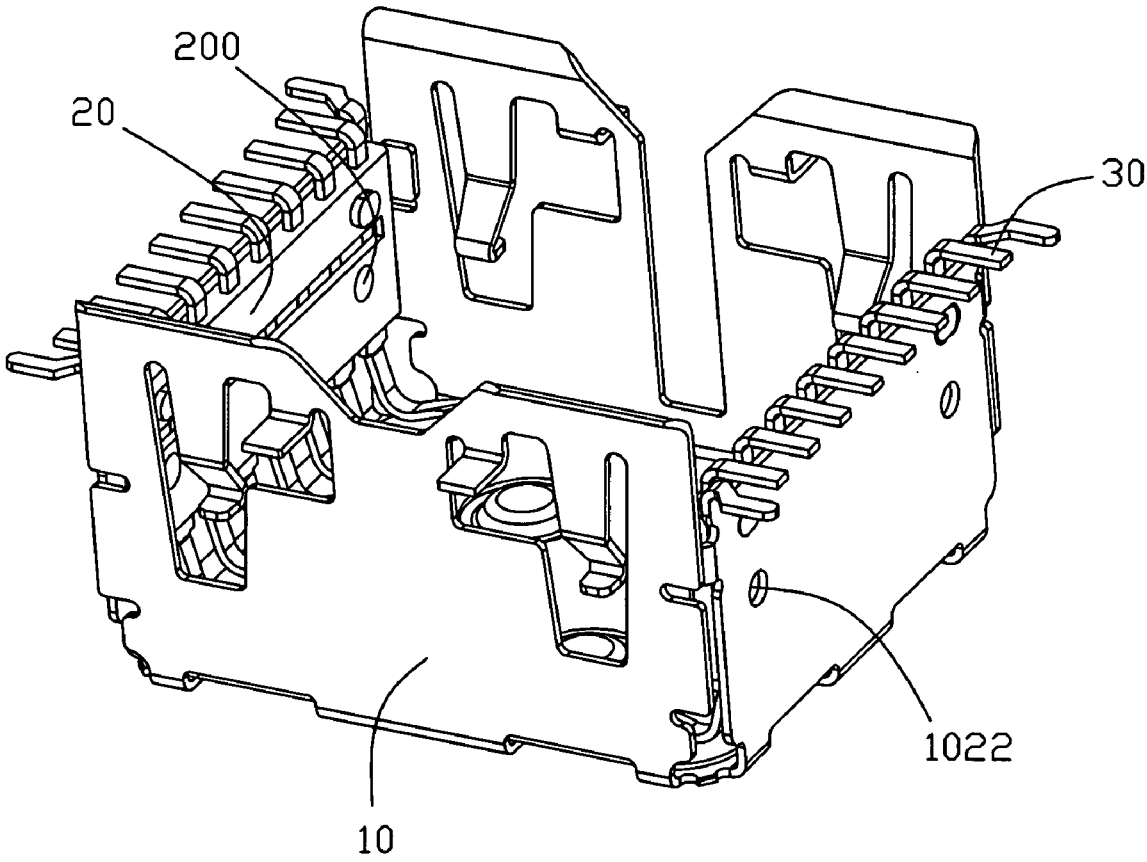
FIG. 2 is a partly assembled perspective view of the shielded connector of the present invention.
Figure 3:
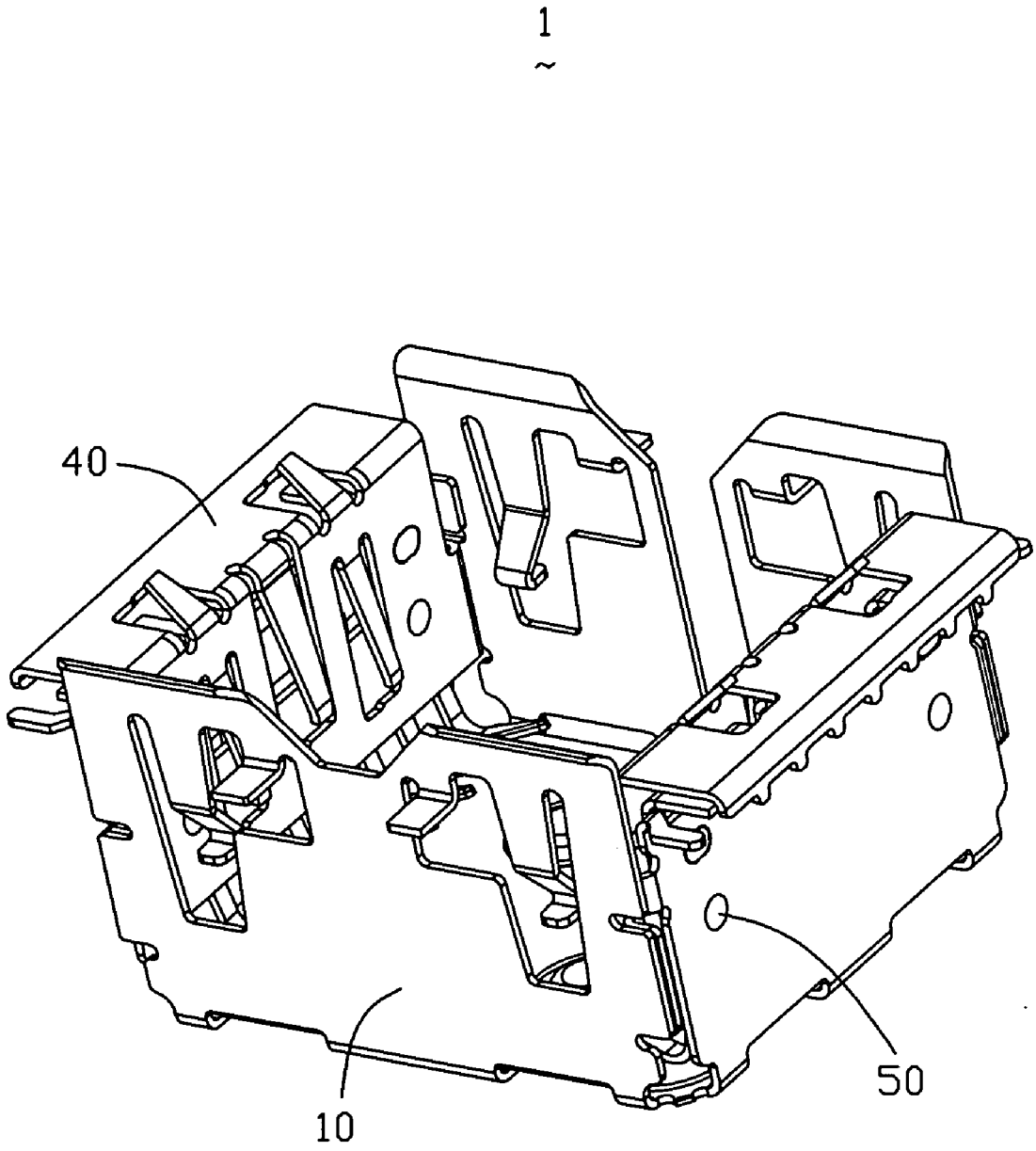
FIG. 3 is a perspective view of the shielded connector of the present invention.
Figure 4:
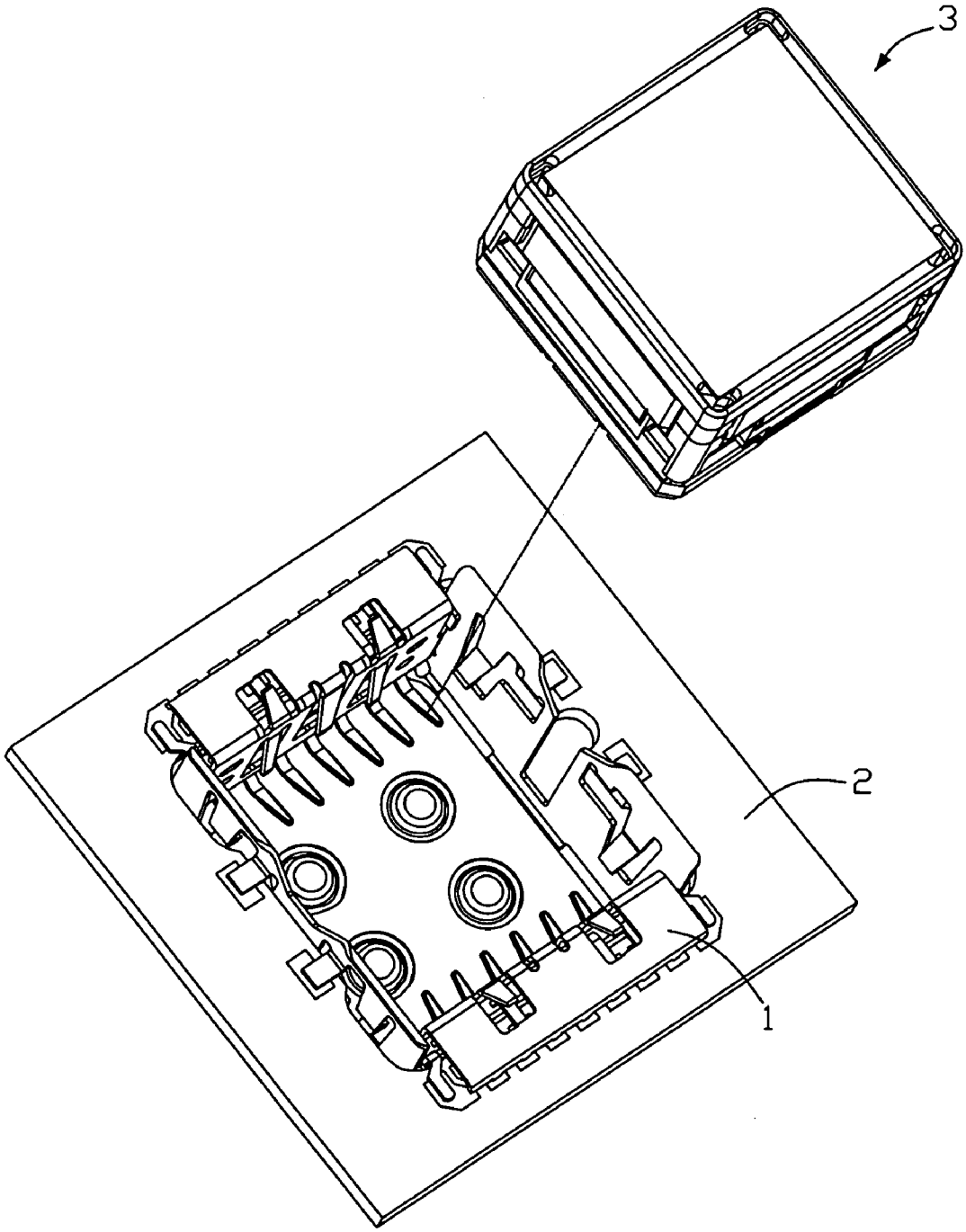
FIG. 4 is a perspective view of the shielded connector of the present invention, wherein the shielded connector have soldered on the printed circuit board and the camera module have not engaged with the shielded connector.
Figure 5:
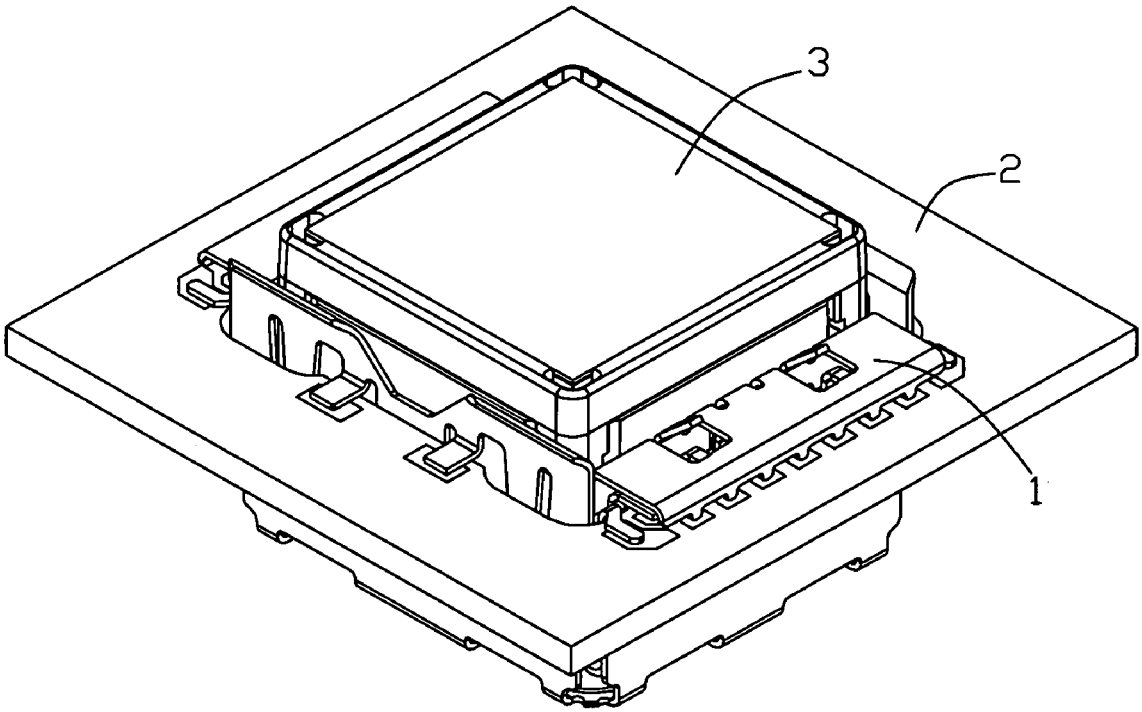
FIG. 5 is a perspective view of the shielded connector of the present invention, wherein the shielded connector have soldered on the printed circuit board and the camera module have engaged with the shielded connector.

FIG. 1 is an exploded perspective view of the shielded connector 1 for receiving a camera module 3 in the embodiment of this invention. In the figure, the reference numeral 10 denotes a metal housing made of a metal material. The reference numeral 20 denotes a pair of insulating housings made of insulating material and the reference numeral 40 denotes a pair of metal shield made of metal material.

The metal housing 10 is made of metal material and configured by first 102, second 101, third 103, and fourth 100 sidewall defining a receiving space 104 therebetween. The metal housing 10 further includes a bottom wall (not labeled) connecting the first 102, second 101, third 103, and fourth 100 sidewalls. Wherein the second 101 and fourth 100 sidewalls have a section higher than the first 102 and third 103 sidewalls.

A window 1014 is provided on a second sidewall 101 for engaging with a corresponding portion of the camera module 3 in order to prevent the camera module 3 from being wrongly received in the receiving space 104. A plurality of locking fingers 1002, 1012 extend from the second and fourth sidewalls 101, 100 inward to the receiving space 104 to contact with and retain the camera module 3. The first and third sidewall 102, 103, separately, has a number of first holes 1022 and first retaining holes 1024, which are arranged in two rows and run through the metal housing 10. A retaining portion 1026 is formed on the two ends of the first and third sidewalls 102, 103 in order to resist the end portion of the insulating housing 20. A plurality of soldering portions 1004, 1028, extend outwardly from the first, second, third, and fourth sidewalls 102, 101, 103, 100 along the horizontal direction in order to mount on the printed circuit board 2. Moreover, a slip 106 is formed between the sidewalls 102, 101, 103, 100 and the bottom wall in order to provide a better verticality therebetween.

Referring again to FIG. 1, each insulating housing 20 is made of insulating material and configured as a flat plate. The insulating housings 20 are attached on the first and third sidewalls 102, 103 of the metal housing 10, respectively, by a number of second holes 200 corresponding with the first holes 1022, and a plurality of retaining sections 204 on a side thereof corresponding with the first retaining holes 1024 and also on an opposite side thereof.

Figure 6:
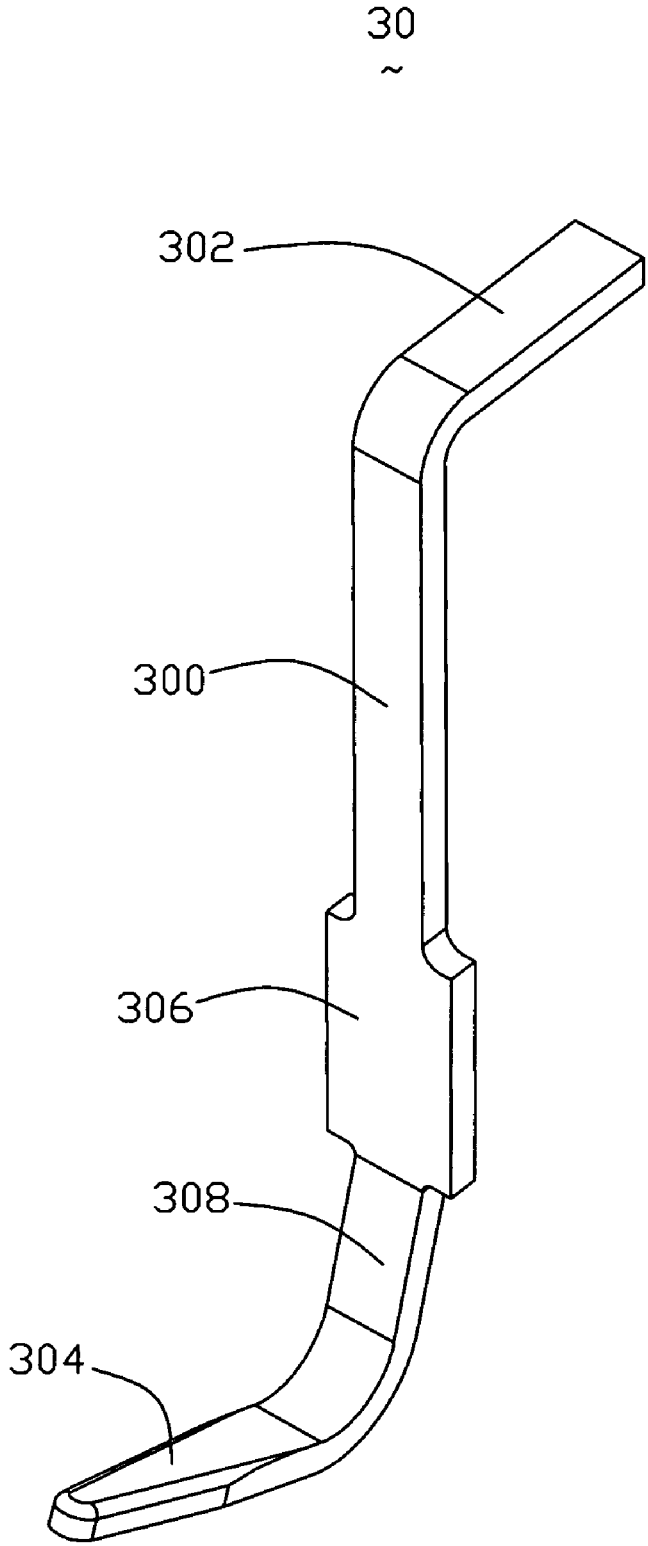
FIG. 6 is a perspective view of the terminal of the shielded connector of the present invention.

Referring to FIG. 6, a plurality of terminals 30 are configured in a "Z"-shape, each comprising a vertical/retaining section 300 covered by the insulating housing 20, a soldering section 302 extending upwardly and outwardly from one end of the vertical section in order to mount on the printed circuit board, and a contact section 304 extending downwardly and slantly from the other end of the vertical section with a contact portion 306 to contact with electrical pads formed on a bottom surface of the camera module 3. And an enlarged portion 306 is formed on the end of vertical section 300 and out of the insulating housing 20. The contact section 304 has a base portion 308, extending from the end of the enlarged portion 306 and being closer to the receiving space 104 of the metal housing 10 than the vertical section 300. Moreover, the vertical section 300 defines a plane extending therethrough, from which the base portion 308 is away.

Each metal shield 40 attached on the first and third sidewalls 102, 103 of the metal housing 10 comprises a vertical body portion 404 and a horizontal portion 402 extending laterally from an upper edge of the vertical body portion 404. The vertical body portion 404 has a flexible finger 4046 and a pair of resilient fingers 4048 located on two sides of the flexible finger 4046, all protruding inwardly for pressing the camera module 3. The vertical body portion 404 further comprises a pair of skirt portion 4040 to connect with the metal housing 10 by spot welding. The horizontal portion 402 has a plurality of soldering pads 4020 on the end thereof so as to connect to the printed circuit board 2. Furthermore, the vertical body portion 404 has a pair of third holes 4042 corresponding with the first holes 1022 of the metal housing 10 and the second holes 200 of the insulating housing 20, and a pair of second retaining holes 4044 corresponding with the first retaining holes 1024 of the metal housing 10 and the retaining section 204 of the insulating housing 20.

The shielded connector 1 further comprises a plurality of fastening means, such as a retaining stick 50, which penetrates the first holes 1022 of the metal housing 10, the second holes 200 of the insulating housing 20, and the third holes 4042 of the metal shield 40 in turn so as to provide a steady connection therebetween via interference engagement.

Referring to FIGS. 2 to 5, in assembling the shielded connector 1, firstly, the terminals 30 are assembled with the insulating housing 20 by insert molding, with the vertical section 300 being covered by the insulating housing 20, the enlarged portion 306 being out of the insulating housing 20 downwardly, and the soldering section 302 being out of the insulating housing 20 upwardly. Secondly, the insulating housings 20 with the terminals 30 and the metal shield 40 are attached to the first and third sidewalls 102, 103 of the metal housing 10, with the retaining sections 204 of the insulating housing being inserted into the first retaining holes 1024 of the metal housing 10 and the second retaining holes 4044 of the metal shield 40 and with the retaining portions 1026 of the metal housing 10 bearing against the two ends of the insulating housings 20 and the skirt portion 4040 of the metal shield 40 bearing against the second and fourth sidewalls 100, 101 of the metal housing 10 and being connected with the metal housing 10 by spot welding. The contact sections 304 of the terminals 30 extend into the receiving space 104 of the metal housing 10 so as to contact with the electrical pads formed on the bottom face of the camera module 3 and the soldering sections 302 extend outwardly of the insulating housings 20 so as to connect to the printed circuit board 2. Then, the retaining sticks 50 penetrate the first holes 1022 of the metal housing 10, the second holes 200 of the insulating housing 20, and the third holes 4042 of the metal shield 40 in turn by interference fit.

When the camera module 3 is inserted into the receiving space 104 from above, the contact pads on the bottom faces thereof are brought into contact with the contact sections 304 of the terminals 30, and the locking fingers 1002, 1012 of the metal housing 10, the flexible finger 4046 and the resilient fingers 4048 of the metal shield 40 contact with the outer periphery of the camera module 3 so as to hold the camera module 3 in the receiving space 104 steadily. Therefore, the camera module 3 is electrically connected to the printed circuit board 2 via the terminals 30. Finally, the shielded connector 1 with the camera module 3 is connected to the printed circuit board 2 by the soldering portions 1004, 1028, of the metal housing 10, the soldering sections 302 of the terminals 30, and the soldering pads 4020 of the metal shield 40.

In the above description of the preferred embodiment, each terminal including at least a vertical section defining a plane extending therethrough and a contact section with a base portion being away from the plane defined by the vertical section. Moreover, an enlarged portion is formed in the end of the vertical section which is out of the insulating housing. Therefore, the deflection of the terminal is reduced and it is impossible that the terminal connected to the metal housing when the camera module presses the terminal excessively.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. A shielded connector comprising:

a metal housing with sidewalls defining a receiving space therein and at least one of the sidewalls having a soldering portion extending outwardly therefrom; and a terminal insert securely attached to the first wall;

the terminal insert including a plurality of terminals secured within an insulating material, each terminal including at least an enlarged retaining section, which is exposed from the insulating material, and a contact section extending from one end of the enlarged retaining section toward to the receiving space;

wherein each terminal further includes a retaining section, which is covered by the molded material and connected to the enlarged retaining section, and a soldering section extending outwardly and perpendicularly from the other end of the retaining section;

wherein the shielded connector further including at least a metal shield attached to the terminal insert;

wherein the shielded connector further including fastening means extending from sides of the metal shield, through the terminal insert and anchored to one of the sidewalls of the metal housing;

wherein the metal shield includes a vertical portion substantially cover the insulative housing and a horizontal portion substantially covering the soldering sections of the terminals;

wherein the horizontal portion having upward resilient fingers; and wherein the metal shield further comprises a pair of skirt portions attached to the sidewalls of the metal housing.

2. The shielded connector according to claim 1, wherein the fastening means is a retaining rod/nail assembling the metal shield, the terminal insert, and the walls of the metal housing through interference.

3. The shielded connector according to claim 2, wherein the insulating housing is pre-molded with a hole for receiving the retaining rod/nail.

4. The shielded connector according to claim 3, wherein the insulating housing is pre-molded with an aligning bud/post.

5. The shielded connector according to claim 4, wherein the sidewalls include first wall, second wall, third wall and forth wall, and the first and third wall is defined with a positioning recess in aligning with the aligning bud/post.

6. The shielded connector according to claim 5, wherein the second and fourth walls have a section higher than the first and third sidewall.

7. The shielded connector according to claim 6, wherein the metal shields includes resilient fingers extending into the receiving space of the metal housing.

8. The shielded connector according to claim 7, wherein each of the second and fourth walls of the metal housing includes locking fingers extending into the receiving space of the metal housing.

* * * * *